United States Patent [19]

Lohman

[11] 4,402,501

[45] Sep. 6, 1983

[54] SUSPENDED UNEVEN PARALLEL BARS FOR COMPETITIVE WOMENS GYMNASTICS

[76] Inventor: Frederick H. Lohman, 58 Fleming Rd., Cincinnati, Ohio 45215

[21] Appl. No.: 307,075

[22] Filed: Sep. 29, 1981

[51] Int. Cl.[3] ..... A63B 3/00

[52] U.S. Cl. ..... 272/63

[58] Field of Search ..... 272/62, 63

[56] References Cited

U.S. PATENT DOCUMENTS 447,811 3/1891 Dinkelman ..... 272/62

783,890 2/1905 Reach ..... 272/62

FOREIGN PATENT DOCUMENTS 2341271 8/1973 Fed. Rep. of Germany ..... 272/63

*Primary Examiner*—Richard C. Pinkham

*Assistant Examiner*—S. R. Crow

[57] ABSTRACT

This disclosure deals with an uneven parallel bar system which provides improved safety and greater speed, convenience and reliability in the adjustment of the bar separation distance to the gymnast's needs, said apparatus comprising two performance bars joined at their corresponding ends by rigidly attached struts of adjustable length, a pair of suspending cables which loop over return pulleys or guides attached to an overhead support beam of the building and attach at their ends to the ends of the bars, and a system of tensioning cables which attach to floor anchors and hold the suspended bars system securely in a static position during use. The specific design of the apparatus permits adjustment of the height and width components of the bar separation distance simultaneously at both ends of the bars by means of a manually controlled or computer controlled electrically powered servo system.

5 Claims, 3 Drawing Figures

SUSPENDED UNEVEN PARALLEL BARS FOR COMPETITIVE WOMENS GYMNASTICS

TECHNICAL FIELD AND BACKGROUND ART

This invention relates to the uneven parallel bars apparatus of girls/womens gymnastics. More particularly, it relates to a design for suspending the two bars, commonly called the "high bar" and the "low bar," from a secure overhead beam or other ceiling mounting for the purpose of providing certain advantages over currently commercially available "approved" apparatus of this category.

Currently commercially available uneven parallel bars approved for competitive use consist of two pairs of heavy, sturdy vertical struts of unequal length in which each pair is joined at the base, a fixed distance apart. About half way up the tallest strut a cross brace ties it and the shorter strut together in a way which permits adjustment of the separation distance between them. The two pairs of struts, or end pieces, are the vertical supports for the horizontal bars on which the gymnast performs, and are, in turn, tied together at the top by the approximately 8 foot long bars. This square arch-shaped assembly is secured in place by rubber friction pads under the base of each end piece and by tensioning cables extending diagonally sideward and front- and rearwards to floor anchors. In spite of the strength and weight of the various supporting members and tensioning cables, apparatus of this design can become unstable as the result of improper positioning of the uprights relative to the floor anchors during set-up, directionally unequal tensioning of the supporting cables, or because of slow gradual movement of the feet of the uprights (vertical struts) during periods of heavy use.

Further disadvantages of currently commercially available uneven parallel bars apparatus are the difficulty of changing the vertical component of the bar separation distance, and the complete lack of comparability of the three arbitrary "setting" numbers, i.e., height setting of high bar and low bar, and a width setting, from one manufacturer's apparatus to another. As a result, much time is spent before meets and at practice sessions establishing the ideal setting for each gymnast and making sure those settings are remembered and/or recorded. The consequences of doing competition-level exercises or routines with an improper setting can be severe bruises and/or sprained lower back muscles, or falls resulting from loss of hand grip during hip beats when the bars are set too far apart.

Finally, apparatus which are not intended to be disassembled for storage require large doorways and relatively large storage areas, whereas those which are designed to be disassembled for storage require the participation of three people to assure that the apparatus does not accidentally collapse during assembly and disassembly.

it is the object of this invention to provide an uneven parallel bar apparatus which permits:

(a) simultaneous adjustment of the height and width components of the bar separation distance, (b) indication of the bar separation distance and angle of inclination in standard length and angle units, (c) microcomputer-controlled rapid, automatic setting of the bar separation distance for gymnasts whose identification and preferred separation distance has been stored in the microcomputer memory, (d) overhead storage of the assembled apparatus under the ceiling of the gymnasium, (e) elimination of the possibility of collapse of the apparatus by virtue of loss of vertical support, (f) a wider area under the bars for more carefree practice and performance of moves under the bars, especially those which utilize lateral extension by elimination of floor-based supports, and (g) suspension of a modern uneven parallel bar arrangement in a fixed, static position at heights suitable for and appropriate to the performance of circus aerial acts utilizing the repertoire of moves and combinations of the gymnastics event for which the apparatus of this invention was developed.

SUMMARY OF THE INVENTION

The present invention is an uneven parallel bar apparatus which meets the aforementioned objectives and, thereby, constitutes a significant improvement over current state-of-the-art apparatus of this type. As an apparatus wherein the performance bars are supported vertically by suspension from a sturdy overhead support, which may be a major, ceiling-level beam of the building, objectives (d), (e), (f) and (g) of the foregoing objectives of the invention are satisfied. Further, the use of an adjustable strut rigidly attached to the ends of the performance bars at each end of the apparatus, operating along a preselected angle of inclination of the performance bars as a means of changing and maintaining the bar separation distance provides a direct means for accomplishing objectives (a), (b) and (c), either manually or by means of known precisely controlled servomechanisms. Further, the design of the floor-anchored tensioning cables and their specific angles relative to the bar separation struts minimizes the amount of adjustment in length, point of attachment, etc., of these floor cables over a wide range of bar separation distance and, thereby, reduces the total time and effort necessary for changes from one bar separation distance to another, thereby assuring that the basic advantages in speed and convenience of the basic bar separation adjustment mechanism are not lost. Finally, the present invention meets the aforementioned highly-desirable objectives without sacrificing the basic performance qualities of a modern uneven parallel bar system, and has the capability of doing so as a fully comparable cost.

DESCRIPTION OF THE DRAWINGS

The apparatus for accomplishing these objectives is diagrammed in FIGS. 1, 2 and 3.

DISCLOSURE OF THE INVENTION

Figure 1:
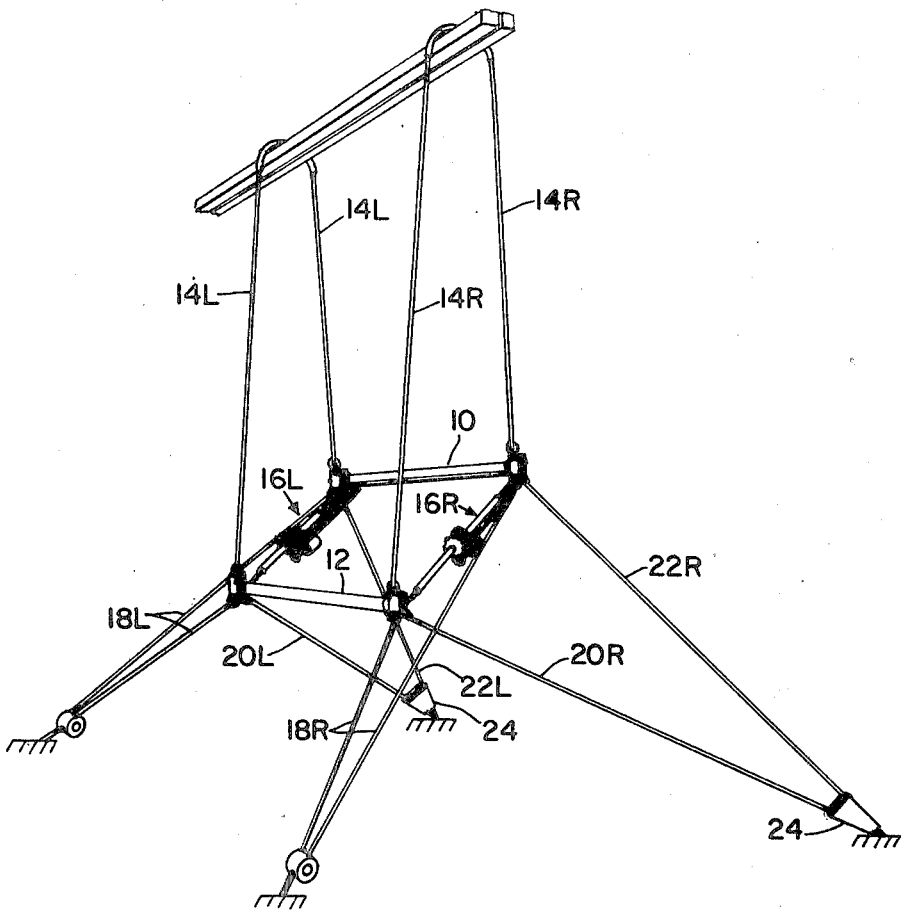
FIG. 1 is a front perspective drawing of the installed apparatus.

Referring to FIG. 1, the high bar 10 and low bar 12 on and around which the gymnast performs are suspended from each end by cables 14L and 14R, which support the left ends and right ends of the bars, respectively. Cables 14L and 14R pass through semi-circular cable guides 15 or over direction reversing pulleys firmly attached to or preferably resting on a major roof-supporting beam, while their ends are securely attached to the corresponding ends of the high and low bars 10 and 12, respectively. Two bar separation adjusting struts 16L and 16R are attached firmly to the adjacent ends of the high and low bars. They are the mechanism by which bar separation distance, at constant angle of inclination, is changed by changing the length of the section of the strut between its points of attachment to the bar ends. Thus, the left ends of the high and low bar and the right ends of the same bars are joined and held in fixed position relative to each other by these bar separation adjusting struts. When the high and low bars have noncircular cross-sections, as they often do, the attachment of the bar separation adjustment strut to the ends of the bars 10 and 12 must all be such that the long axes of the bar cross-sections and the bar-separation adjusting struts make the same acute angle of $45° \pm 10°$ relative to each other.

The suspended bars assembly is then placed in tension between the overhead support and the floor by means of cables 18L and 18R, 20L and 20R, and 22L and 22R attached to the left and right ends of the bars, respectively, so that its position is as close as possible to the hanging rest position of the suspended assembly. The relative lengths of 18L and 22L on the left side and 18R and 22R on the right side must be adjusted at the time of installation so that the angle of inclination of the high and low bars is $45° \pm 5°$ and equal to the angle formed by the bar separation adjusting strut and the long axis of the bar cross-section. Note that cables 18L and 18R have two strands (like 14L and 14R) which are formed by looping the cables through a direction-reversing guide or pulley attached to the floor anchor.

It is important to the unique functioning of the invention, i.e., suspended uneven parallel bars with simultaneous height and width adjustment, that the following be satisfied:

(1) the projection of the low-bar-strands of cables 18L and 18R in the vertical planes defined by the left ends and right ends of the bars 10 and 12, respectively, should be approximately straight-line extensions of the bar separation adjusting struts 16L and 16R on each side. Thus, the tensioning force vectors projected in those planes will be perfectly in line with the bar separation adjusting struts and will help to maintain the alignment dictated by the designed angle of inclination of the bars.

(2) The projection of cables 22L and 22R in the same vertical plane should be perpendicular to the bar separation adjusting struts (16L and 16R) when the bars are at the center of the bar-separation range.

When conditions (1) and (2) are met, a change in the separation distance of the bars of any magnitude within the 18" range of the apparatus can be made with essentially no change in the angle of inclination of the bars and with little or no change in the length of the tensioning cables other than a minor detentioning to ease friction on the adjustment mechanism before the bar separation adjustment and a retentioning after the adjustment. This is demonstrated by reference to FIG. 1. Cables 14L and 14R, by virtue of their overhead loop support and fixed length, accommodate to the increase or decrease changes of the bar ends along the line of the bar separation struts. Thus, as the points of the attachment of cables 14L and 14R to the high bar 10 move up and out in the direction of the strut, its cable strand shortens. At the same time, the points of attachment of cables 14L and 14R to the low bar 12 move down and out along the strut direction, taking up exactly the cable length transferred over the pulley or cable guide from the high bar strands of 14L and 14R.

The same principles are employed with cables 18L and 18R which are, for purposes of bar separation adjustment, fixed length cables pivoting over direction changing pulleys or guides at the front floor anchors. In this case, as the low-bar-tensioning strands of cables 18L and 18R shorten as the low bar ends move down and out, the high-bar-tensioning strands' lengths are increased by the same amount exactly accommodating the needs of the high bar ends moving up and out along the same line as the low bar ends move.

Cables 20L and 20R and 22L and 22R are separate fixed length cables. The projection of cables 22L and 22R in the vertical planes containing the bar ends on either side of the apparatus should form a 90° angle with the bar separation adjustment struts when the bar separation is at the middle of its range, as has been previously stated. Under these circumstances, the arcs traced by the movement of the upper ends of cables 22L and 22R are approximately the same as the tangent line to the arc which is the line traced by the bar ends as the separation distance is decreased or increased from the mid-range position. The positions of the floor anchors relative to the hanging rest position of the bars assembly should be chosen so as to set up these prescribed conditions for cables 18L and 18R and 22L and 22R. Cables 20L and 20R may be adjustable in length by turnbuckles (not shown) or any other suitable device. They help stabilize the low bar against forward movement in the horizontal plane. Their length is set so that they are taut at the maximum bar separation distance without distorting the angle of inclination of the bars. A pair of tensioning devices, 24L and 24R, span 20L and 22L and 20R and 22R; by sliding these up the cables, tension is restored to cables 20L and 20R when slack in them is produced by reducing the bar separation distance. A large reduction in the bar separation distance may make it necessary to shorten the length of 20L and 20R by other means such as turnbuckles.

DESCRIPTION OF PREFERRED EMBODIMENTS

Figure 2:
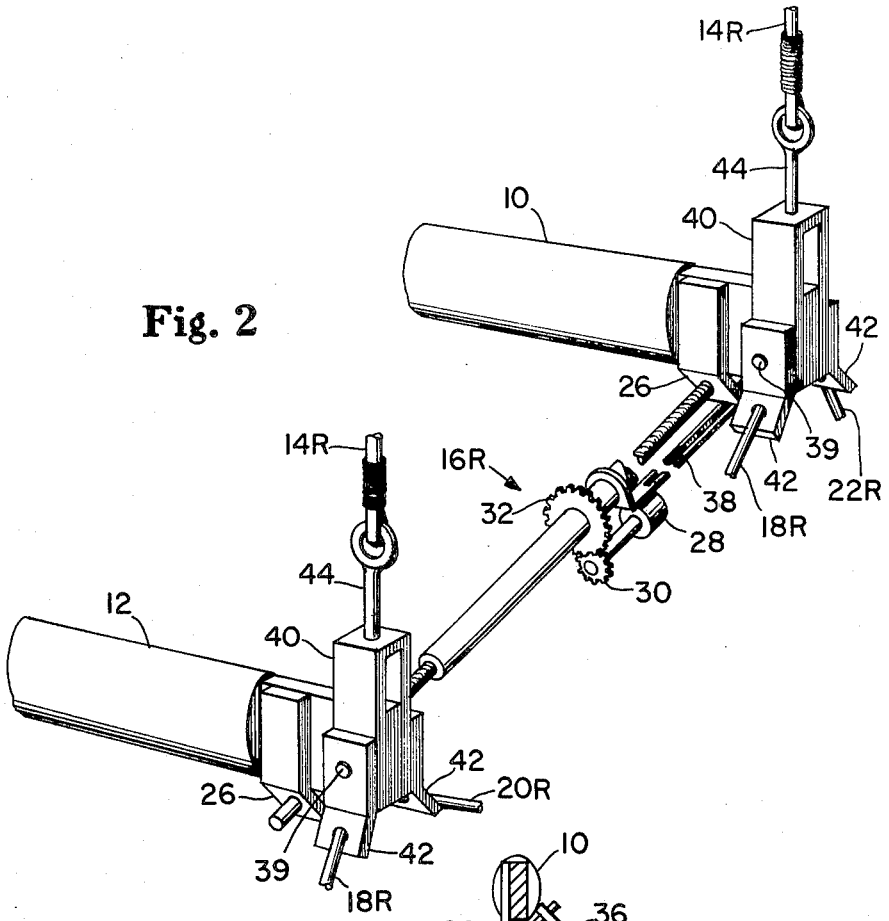
FIG. 2 is a perspective drawing of a method for connecting the bar ends which permits simultaneous adjustment of the height and width components of the bar separation distance and a method for attaching the support cables for placing the bars assembly in tension.
Figure 3:
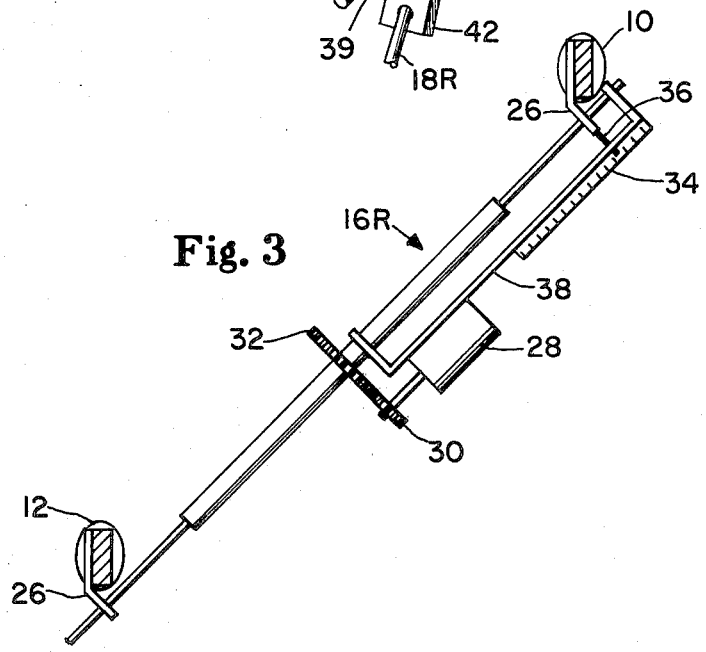
FIG. 3 is an end-view drawing of a possible electric drive mechanism and its mounting for adjusting bar separation distance.

Some preferred embodiments of this invention are designed to permit simultaneous adjustment of the bar separation distance to be made automatically or by remote control. One such embodiment is shown in the drawings of FIG. 2 and FIG. 3, in which the cables have been eliminated for clarity. It employs struts, 16L and 16R, both ends of which are threaded, one end with a right-hand thread and the other with a left-hand thread, and screwed into matching nuts or threaded holes 26 attached rigidly and firmly to the ends of the high and low bar on each end. (See FIG. 2) Thus, when these bar separation adjusting screws are turned in one direction, i.e., clockwise, for example, the bars are moved apart, and when the direction is reversed they move together always along the spatial direction of the screws so that the angle of inclination remains constant.

FIG. 3 shows a method of accomplishing this simultaneous adjustment of the vertical and horizontal components of the bar separation distance at both the right and left ends of the bars. A reversible electric motor 28 with its small drive gear 30 drives the matching larger diameter gear 32 on the center section of the bar separation adjusting screw on each end of the bars assembly. The matched motors are connected in parallel and controlled by a three-way switch for "ON FWD", "ON REV" and "OFF". Thus, both the height and width components of the bar separation distance are adjusted at both ends of the bars simultaneously by operating an electrical switch. Scales for direct measurement of the bar separation distance in standard units of length 34 are mounted on the bar separation adjusting mechanism as shown in FIG. 3, where a pin 36, mounted in the threaded adapter 26 which attaches the bar separation adjusting screw to the top bar 10, indicates the separation on a scale where a scale unit of $\frac{1}{2}''=1''$ of actual bar separation. The pin 36 which indicates bar separation distance serves another important function in this bar separation adjusting mechanism (FIG. 3). It extends through a narrow slot in the base 38 of the motor mounting bracket which is suspended from the bar separation adjusting screw at the top and center by the end pieces which have holes fitted with bushings in which the screw can turn freely. Thus, the pin, by virtue of its rigid attachment to the bar end, prevents the motor mounting bracket from rotating in planetary fashion around the screw. The bar separation adjusting mechanism shown in FIG. 3 is repeated at the opposite end of the apparatus in an identical manner.

Another preferred embodiment of this invention, which is not diagrammed, employs bar separation adjustment struts which consist of a hydraulic cylinder section and one or two ends which are extensions of pistons inside the cylinder. When the appropriate section of the cylinders is pressurized (by an electric hydraulic pump, for example), the piston(s) and extension(s) move out, and with them, the ends of the high and low bars to which they are rigidly attached, and bar separation distance increases.

To decrease the bar separation distance, the section(s) of the hydraulic cylinders on the opposite side(s) of the piston(s) are pressurized by manual or automatically controlled valves causing the piston(s) and end section(s) of the struts attached to the bar ends to retract. Indication of the bar separation distance is readily accomplished by scales attached to the stationary cylinder section of these hydraulic struts and a "pointer" attached to one of the movable ends.

A third preferred embodiment pertains to the method of attachment of the overhead support and floor-anchored tensioning cables so as to permit the natural rotational motion of the bar ends in the vertical plane parallel to the bars 10 and 12 when the latter are flexed vertically during use. At the same time, all of the force vectors which emanate from the bar ends intersect at a single point thus preventing the application of any twisting along the length of the bars. A preferred embodiment of this type is shown in FIG. 2. In this method of attachment, a hole is drilled through each end of each bar perpendicular to the long axis of the bar cross-section and the length of the bar. The size of the hole should be large enough to accommodate a bolt or pin 39 of sufficient strength to tolerate the considerable forces resulting from placing the bars in tension sufficient to hold them (the bar ends) in fixed positions during use. A clevis 40 with an interior width just sufficient to span the bar end without binding and holes which match or slightly exceed the size of those in the bar ends is positioned at each bar end as shown. A cable attachment plate 42 with a hole, matching or slightly exceeding in size those in the bar ends, drilled in one end, is positioned outside each arm of each clevis. The bolt or pin 39 (See FIG. 2) with a diameter which matches the holes in the ends of the bars is passed through these assembled parts and the bar end and held together snugly, but without binding the parts to each other, by a self-locking nut or other capping device.

Each clevis 40 has a hole in the closed end (fork) to accept the threaded end of an eye bolt 44, the eye of which serves as the point of attachment for one end of one of the suspension cables 14L and 14R. The closed-end to open-end length of the clevis should be sufficient to provide clearance between its closed end and the top of the bar end which it spans for about three inches of threaded end of the eye bolt to permit convenient fine adjustments in the heights (above the floor) of the ends of the high and low bars, 12 and 10, respectively. Each individual cable attachment plate 42 has its free end bent outward from the bar at an angle of about 45°. This free end has a hole in it of sufficient size to accept a cable loop and a strand of tensioning cable which will ultimately be connected to the appropriate floor anchor (See FIG. 1). These three cable-attachment pieces which are free to pivot on the bolt or pin which attaches them to the bar end constitute the attachment system of this preferred embodiment. As previously stated, they allow the flexible bars 10 and 12 to function as designed. In addition, they provide a considerable degree of latitude in the lateral or outward positioning of the floor anchors and overhead supports.

The mechanisms described in the foregoing preferred embodiments are only three examples of a number of mechanisms which could be employed to accomplish the functional aspects of the invention which they address. The claims of this invention are not restricted to or by these examples. The parallel, electrically controlled adjustment of the height and width components of bar separation at both ends of the apparatus simultaneously makes it possible for microcomputer-controlled setting of the bar separation distance to a preselected value. All that is necessary is for the gymnast to store her correct, or preferred, bar separation distance in standard length units in her location in the computer's memory. A program, which keeps track of the bar separation setting at all times, reads the memory location inputted to it, compares the new setting with its present one, and computes the magnitude and direction of the change which must be made to arrive at the new setting, then can start the bar separation mechanism at both ends in the computed direction and stop it at the appropriate separation.

What is claimed in this invention is:

1. A suspended uneven parallel bar apparatus for gymnastics comprising:

(a) two matching flexible performance bars approximately 8 feet long, each end of which has a hole passing through perpendicular to the length of the bar and to an axis of the cross-section, (b) a pair of struts of adjustable effective length which connect the adjacent ends of the two performance bars in a way which holds the bars in approximately parallel configuration relative to each other when adjusted, while at the same time being the instruments for changing the bar separation distance to suit the performer, (c) a means of attachment of the bar separation adjusting struts to the performance bar ends which rigidly holds the said axis of their cross-sections parallel to each other and also the holes through the corresponding ends of the two bars parallel to each other at a specific fixed angle in the range 45°±10° to the struts, (d) a pair of wire ropes of appropriate length for suspending the performance-bars and separation-adjusting-struts assembly from an overhead support with the bars horizontal lengthwise and with corresponding points on the low bar and high bar forming an angle of inclination of 45°±10° to horizontal and with the entire bars assembly at the desired height from the floor, said functions being accomplished by hanging each wire rope over a direction-reversing cable guide attached firmly to said overhead support and separated from the other by about ten feet, and attaching the ends of each wire rope to corresponding ends of the performance bars using the holes in the bar ends of points of attachment, (e) a system of wire ropes connecting the ends of the performance bars to floor anchors positioned forward-outward and rearward-outward from the bar ends which hold the bars assembly in tension in the desired fixed position between the overhead supports and the floor anchors, said system comprising:

(1) two wire ropes which loop around direction-reversing devices attached to the right and left forward-outward-placed floor anchors and whose ends are attached to the ends of the performance bars on each side of the apparatus, (2) two wire ropes which connect the right and left ends of the highest performance bar to the rearward-outward extending floor anchors, respectively, (3) two wire ropes which connect the right and left ends of the lowest performance bar to the corresponding rearward-outward-extending floor anchors, (f) a means for attachment of the floor-anchored tensioning wire ropes to the ends of the performance bars which minimizes the possibility of twisting moments or torques being applied to the performance bars along their length as an axis as a result of unequal tensioning forces among the wire ropes, while at the same time permitting, as much as possible, the natural rotation of the bar ends in the vertical plane about the suspension point as the center sections of the bars are flexed vertically by the gymnast during use.

2. The invention of claim 1 wherein the bar separation adjustment struts are circular rods, both ends of which have threaded sections approximately 9 inches long of opposite direction, i.e., right-hand and left-hand threads, and the means of attachment of the strut to the adjacent ends of the two performance bars are adapter plates, one end of which attaches firmly to the bar end and the free end of which has a right- or left-handed threaded hole which matches the appropriate threaded end of one of the struts, and whose axis makes an angle of 45° to the said axis of the cross-section of the performance bars.

3. The invention of claim 1 wherein the effective lengths of the bar separation adjustment struts, the lengths of the sections between the ends of the high and low bars, are changeable at both ends of the bars assembly simultaneously at the same rate and the bar separation distance being indicated in standard length units by an appropriate scale or display.

4. The invention of claim 1 wherein all of the wire rope attachments to each of the performance bar ends are free to pivot on a common axle extending from the bar end horizontally and perpendicularly to the bar length.

5. The invention of claim 1 wherein the floor anchor points are positioned relative to the performance bars and separation struts assembly so that the projections in the vertical planes defined by the bar ends of the forward-outward-extending tensioning cables attached to the ends of the lowest performance bar are straight-line extensions of the bar separation struts, and the projections in the same vertical planes of the rearward-outward-extending tensioning cables attached to the ends of the highest performance bar are perpendicular to the struts when the bars are at the center of the bar-separation range.

* * * * *